US006410811B2

(12) United States Patent
Chau et al.

(10) Patent No.: US 6,410,811 B2
(45) Date of Patent: Jun. 25, 2002

(54) SELECTIVE HYDROGENATION PROCESS COMPRISING PARTIAL SEPARATION OF HYDROGEN BY A MEMBRANE UPSTREAM OF A REACTIVE COLUMN

(75) Inventors: Michel Chau; Michel Derrien, both of Rueil-Malmaison; Alain Methivier, Orleans, all of (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 0 days.

(21) Appl. No.: 09/800,508

(22) Filed: Mar. 8, 2001

(30) Foreign Application Priority Data

Mar. 8, 2000 (FR) ..... 00 0366

(51) Int. Cl.[7] ..... C07C 5/03; C07C 5/08; C07C 7/163; C07C 7/14; C10G 45/00

(52) U.S. Cl. ..... 585/259; 585/260; 585/262; 585/264; 585/265; 585/324; 585/818; 208/92; 208/144; 208/145

(58) Field of Search ..... 208/92, 144, 145; 585/259, 260, 262, 264, 265, 324, 818

(56) References Cited

U.S. PATENT DOCUMENTS 5,368,691 A 11/1994 Asselineau et al. ..... 203/29
5,679,241 A 10/1997 Stanley et al. ..... 208/92
5,882,382 A * 3/1999 Hachisuka et al. ..... 96/13

FOREIGN PATENT DOCUMENTS

WO WO 95/15934 6/1995

* cited by examiner

*Primary Examiner*—Walter D. Griffin
*Assistant Examiner*—Tam M Nguyen
(74) *Attorney, Agent, or Firm*—Millen, White, Zelano & Branigan, P.C.

(57) ABSTRACT

The process of the invention is a process for selective hydrogenation of a hydrocarbon feed containing hydrogen and $C_2^+$ hydrocarbons, characterized in that it comprises at least one step for separating a fraction of the hydrogen contained in the feed by means of a membrane (step a)) and a step for selective hydrogenation of the effluent from step a) in a reactive column (step b)).

15 Claims, 1 Drawing Sheet

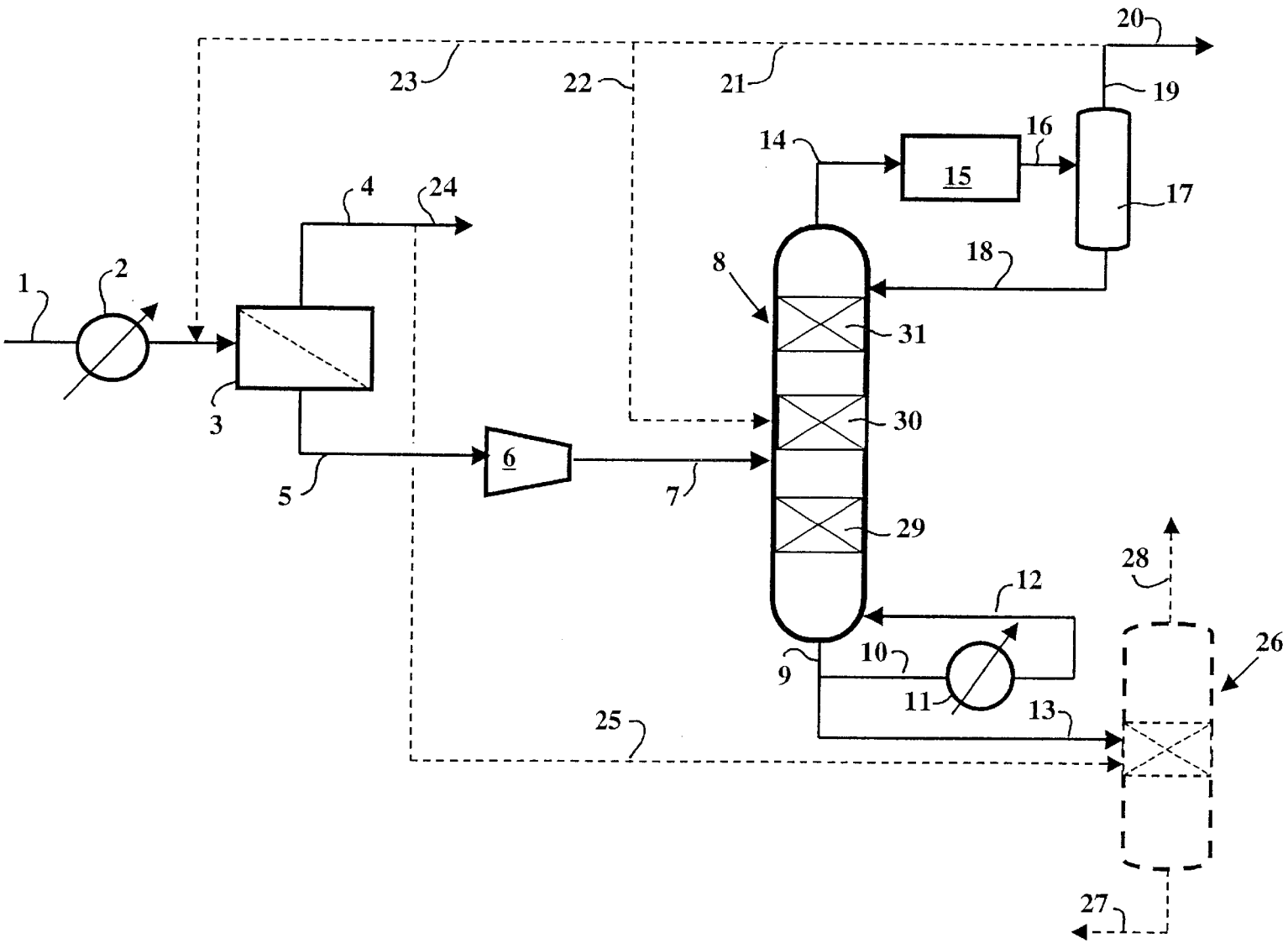
1
2
3
4
5
6
7
8
9
10
11
12
13
14
15
16
17
18
19
20
21
22
23
24
25
26
27
28
29
30
31

SELECTIVE HYDROGENATION PROCESS COMPRISING PARTIAL SEPARATION OF HYDROGEN BY A MEMBRANE UPSTREAM OF A REACTIVE COLUMN

The present invention relates to a process for selective hydrogenation of a hydrocarbon cut in a reactive column. The feed for the process of the invention essentially comprises hydrocarbons containing 1 to 6 carbon atoms, and hydrogen and possibly $C_6^+$ hydrocarbons, containing 6 or more carbon atoms. Said process can hydrogenate acetylenic compounds, and di- and poly-olefins, without significantly affecting the mono-olefins present in the feed.

PRIOR ART

A number of types of conversion process have been developed to produce unsaturated compounds from the hydrocarbons contained in petroleum cuts or in natural gas. In particular, they are steam cracking, catalytic cracking (FCC), visbreaking, coking or pyrolysis processes. Such processes produce gaseous or liquid hydrocarbons with a degree of unsaturation that increases as the treatment temperature is raised. At the end of such processes, a mixture of hydrocarbons containing mono-olefinic, di-olefinic or poly-olefinic and acetylenic compounds is obtained in variable proportions, possibly along with hydrogen in varying amounts.

In order to obtain the olefins desired to supply petrochemical or fine chemical processes, the effluents from such processes have to undergo a hydrogenation treatment to selectively hydrogenate the di- or poly-olefins and acetylenic compounds and to avoid hydrogenating mono-olefins as much as possible.

The selective hydrogenation step is generally carried out after fractionating said effluents into a plurality of cuts. Each of the separated cuts is then hydrogenated separately in a specific reactor. Thus International patent application WO-A-96/06900 describes a process for selective hydrogenation of cracked gas, in which the gas from a steam cracker is fractionated in order to remove the methane ($C_1$) then the $C_2$ and $C_3$ compounds (i.e., compounds containing 2 or 3 carbon atoms per molecule). The fraction containing $C_4$ compounds (compounds containing 4 carbon atoms) and $C_5^+$ compounds (compounds containing 5 carbon atoms or more) is then hydrogenated and a fraction of the hydrogenated effluent is recycled to the fractionation section.

In general, the hydrogen necessary for the hydrogenation reaction and the feed containing the hydrocarbons to be hydrogenated arrive at the hydrogenation reactor separately. International patent application WO-A-95/15934 describes a process in which the stream of hydrogen on the one hand and a stream of hydrocarbons on the other hand are separately supplied to a hydrogenation reactor. Those two separate streams can optionally be mixed just before they enter the reactor.

U.S. Pat. No. 5,679,241 describes a process in which a feed containing all of the $C_2$ to $C_6$ hydrocarbons, heavier unsaturated hydrocarbons and hydrogen is sent to a reactive column for hydrogenation, with no prior hydrogen separation. The excess hydrogen over the quantity necessary for the reaction traverses the catalytic column without being converted then is separated downstream in a hydrogen recovery unit.

Thus, the prior art describes processes in which all of the hydrogen is separated from a gas stream either upstream or downstream of a hydrogenation unit.

Complete upstream separation requires cryogenic type units that are very expensive. Downstream separation involves the excess hydrogen circulating in the hydrogenation reactor. That excess hydrogen causes risks of runaway and renders control of the reaction more complex.

SUMMARY OF THE INVENTION

The present invention concerns a process for selective hydrogenation of a hydrocarbon cut in a reactive column (also termed a catalytic column). The feed for the process of the invention essentially comprises hydrocarbons containing 1 to 6 carbon atoms and possibly $C_6^+$ hydrocarbons. Said process can hydrogenate acetylenic compounds, and di- and poly-olefins, without significantly affecting the mono-olefins present in the feed. Said feed also comprises hydrogen in varying quantities, depending on the upstream process from which it originates (for example a steam cracking process or a thermal cracking process or catalytic cracking process or a pyrolysis process).

In the process of the invention, partial hydrogen separation is carried out upstream of the selective hydrogenation. Preferably, only a quantity substantially equal to or slightly greater than the quantity of hydrogen necessary for the reaction is left in the feed. This partial separation is preferably carried out using a membrane, rather than cryogenically. Cryogenic separation is better suited to substantially complete separation of hydrogen from the feed and investments are much higher.

Separating a fraction of the hydrogen present in the feed means that investments are much lower and the partial pressure of the hydrogen can be reduced, thus enabling the hydrogenation reaction to be better controlled. In the case of hydrogenation of light hydrocarbons, in particular $C_2$ or $C_3$ hydrocarbons, too high a partial hydrogen pressure can result in runaway and cause the temperatures to become very high, as well as causing hydrogenation of the mono-olefins present in the feed.

DETAILED DESCRIPTION OF THE INVENTION

The present invention concerns selective hydrogenation of a feed composed of $C_2^+$ hydrocarbons (hydrocarbons containing at least 2 carbon atoms per molecule), i.e., hydrogenation of acetylenic compounds or di- or poly-olefins contained in said feed.

The process of the invention is a process for selective hydrogenation of a hydrocarbon feed containing hydrogen and $C_2^+$ hydrocarbons, characterized in that it comprises at least one step for separating a fraction of the hydrogen contained in the feed by means of a membrane (step a)) and a step for selective hydrogenation of the effluent from step a) in a reactive column (step b)).

The feed for the process of the invention is a hydrocarbon feed also containing hydrogen and preferably originating from a steam cracking process, a heat cracking process, a catalytic cracking process or from a pyrolysis process.

The term "$C_n$ hydrocarbons" or "$C_n$ cut" will henceforth define a mixture of hydrocarbons containing n carbon atoms per molecule, and a "$C_n$–$C_m$ cut" will define a mixture of hydrocarbons containing n to m carbon atoms per molecule. As an example, a $C_1$–$C_6$ cut contains hydrocarbons containing 1 to 6 carbon atoms per molecule.

Preferably, the feed for the process of the invention is a $C_1$–$C_6$ cut (i.e., a cut containing hydrocarbons containing 1 to 6 carbon atoms per molecule). Said feed can also be selected from $C_1$–$C_2$, $C_1$–$C_3$, $C_1$–$C_4$, $C_1$–$C_5$, $C_1$–$C_6$, $C_2$–$C_3$, $C_2$–$C_4$, $C_2$–$C_5$, $C_2$–$C_6$, $C_3$–$C_4$, $C_3$–$C_5$, $C_3$–$C_6$, $C_4$–$C_5$, $C_4$–$C_6$, $C_5$–$C_6$ cuts or a mixture of said cuts, when said cuts or said mixture also contain hydrogen, optionally added or already present in said cut or said mixture. It is also possible to treat in the process of the invention any feed containing hydrogen and at least 2 cuts selected from the group formed by $C_2$, $C_3$, $C_4$, $C_5$ or $C_6$ cuts.

Further, said feed can optionally contain $C_6$+ hydrocarbons, preferably in an amount of less than 20% by weight, and methane ($C_1$). Preferably, the feed for the process of the invention contains hydrogen, methane, $C_2$–$C_6$ hydrocarbons and $C_6$+ hydrocarbons. Highly preferably, said feed is from a steam cracking process or from thermal cracking or from a pyrolysis process.

Routinely used process layouts for steam cracking processes are described in "Ullman's Encyclopedia of Industrial Chemistry", fifth edition, volume A10, pages 77 and 80. When the feed is from a steam cracking process, the hydrogenation process of the invention is preferably installed after the caustic soda and compression steps, more preferably after the cracked gas drying step. Such preferred implementations of the invention allow membrane separation and hydrogenation at a higher pressure.

It is also optionally possible to install the process of the invention after the de-ethaniser, when the latter is placed upstream of the de-methaniser. The feed must then be re-heated, for example using an exchanger supplied by part of the steam generated by the steam cracking unit.

It has been discovered that recently developed membranes can carry out partial separation of the hydrogen contained in a hydrocarbon feed originating, for example, from a steam cracking, thermal cracking or catalytic cracking process or from a pyrolysis process.

It has also been discovered that this separation (step a)) can produce an effluent with a suitable composition as regards the mole ratio of hydrogen to hydrocarbons to be hydrogenated (ratio R, defined below). Said effluent can then supply, preferably directly, a reactive column in which a selective hydrogenation catalyst based on at least one metal preferably selected from groups 8, 9 or 10 of the new periodic table (group VIII, old periodic table) is disposed.

In some cases, it may be useful or even necessary to compress and/or re-heat the effluent from step a), before carrying out the hydrogenation step (step b)).

In order to limit the risks of runaway of the reaction and/or mono-olefin hydrogenation, the mole ratio:

R=hydrogen:(di-olefins+poly-olefins+acetylenics)

of the effluent containing most of the hydrocarbons at the end of step a) of the process of the invention (retentate of the membrane separation process) is preferably in the range 0.5:1 to 4:1, more preferably in the range 0.8:1 to 3:1, still more preferably in the range 1:1 to 3:1 and highly preferably in the range 1.1:1 to 2.5:1, or in the range 1.2:1 to 1.8:1.

Gas permeation membranes can separate gas mixtures by selective transfer under pressure difference through a thin continuous layer of a polymer, a composite material (for example a polymer charged with mineral crystallites) or through a ceramic or an inorganic material.

This gas permeation separation process can be applied to hydrogen separation. A permeate containing the species that have traversed the membrane, in this case enriched in hydrogen, is collected in the compartment downstream of the permeator (membrane separation unit, also termed the permeation unit). A retentate is obtained at the outlet from the compartment upstream of the permeator, which in the present case is depleted in hydrogen, and contains most of the hydrocarbons initially present in the feed.

The quantity of hydrogen that can be recovered in the permeate and its purity depend on a number of factors, in particular the composition of the gas to be separated, the temperature, and the pressure of the gas supplying the membrane separation unit (permeation unit), the pressure at which the permeate is recovered, the surface area of the membrane used, and the permeability and selectivity of the membrane.

The operating conditions for the membrane separation unit used in step a) of the process of the invention are generally as follows:

- supply pressure: in the range 0.5 to 10 MPa, preferably in the range 1 to 7 MPa, more preferably in the range 2 to 5 MPa;
- permeate pressure: in the range 0.1 to 5 MPa, preferably in the range 0.1 to 4 MPa, more preferably in the range 0.3 to 1.5 MPa;
- temperature: in the range 20° C. to 120° C., preferably in the range 40° C. to 100° C., more preferably in the range 45° C. to 90° C., in the case of an organic membrane; or in the range 50° C. to 500° C., preferably in the range 70° C. to 400° C., more preferably in the range 100° C. to 350° C. in the case of mineral membranes (inorganic).

Membrane separation techniques are generally easy to implement, as permeation units are usually modular, operated continuously, and consume little energy. However, their costs are linked to the membrane and modules. The membrane units thus represent a scale factor that is not favourable to the production of large units. Now, in the case of the process of the invention, the flow rates of the feed to be treated are generally very high.

Thus, for example, in the preferred case of a feed from a steam cracking process, feeds with a flow rate in the range from a few tens to a few hundred tons per hour are routinely treated. Typically, a $C_1$–$C_6$ steam cracking cut is available at the outlet from a steam cracking unit at a flow rate in the range from a few tens of tons per hour to a few hundred tons per hour. The membrane used in the process of the invention must therefore be capable of treating such flow rates, while having a sufficient hydrogen separation selectivity.

Any type of membrane can, a priori, be used in the process of the invention. However, an organic membrane is preferably used as the Applicant has discovered that this type of membrane can treat high feed flow rates, with high hydrogen separation selectivity and with membrane surface areas that are compatible with an industrial use.

Currently, mineral membranes have the advantage of being highly stable thermally and sufficiently selective. Thus there is usually no technical incompatibility with their use in the process of the invention.

However, the surface areas of mineral membranes required to treat the feeds of the process of the invention are still usually too high, meaning that the investments are often too high. Since membrane technology is recent, substantial progress has already been made and is to be expected in the short term. Mineral membranes will then be better suited to the process of the invention. In the case of hydrogen separation, zeolite based membranes come into consideration, or membranes based on carbon fibres (carbon molecular sieve membranes: CMSM) sold, for example, by CARBON MEMBRANES Ltd., and which are particularly suitable for separating hydrogen, or for membranes based on microporous silica deposited on a porous support such as alumina, or membranes comprising an alloy of palladium and a further metal such as silver. The mineral membranes that can be used in the process of the invention will thus preferably be selected from the group formed by: zeolites, membranes based on carbon fibres, membranes based on microporous silica deposited on a porous support, ceramic membranes and membranes comprising a palladium-based alloy.

The organic membranes that are preferably used in the process of the invention preferably comprise a polymer such as at least one polymer selected from the group formed by: polyimides, polyaramides, polycarbonates, polysulphones, cellulose derivatives and polyvinyl fluorides. Preferably and advantageously, polymer-based membranes, in particular polyaramide-based polymers sold by MEDAL, are used.

These organic membranes can treat very high feed flow rates, for example 90000 $m^3$ per hour, and can produce permeate flow rates that vary depending on the operating pressures and temperatures used, for example 15000 $m^3$ per hour. Such a separation can be carried out in compact modules with a surface area of the order of 7 $m^2$.

At the end of the membrane separation step, a permeate containing the species that have traversed the membrane is obtained, i.e., essentially hydrogen and small quantities of hydrocarbons, and a retentate that is depleted in hydrogen, but containing most of the hydrocarbons initially present in the feed.

The retentate, which preferably has a mole ratio R in the range 0.5:1 to 4:1, more preferably in the range 0.8:1 to 3:1 (R=hydrogen: (di-olefins+poly-olefins+acetylenics), is then sent to selective hydrogenation step b) of the process of the invention.

Step b) for selective hydrogenation of di-olefinic hydrocarbons, poly-olefinic hydrocarbons and acetylenic hydrocarbons is operated in a reactive column comprising at least one, preferably a plurality, of fixed catalyst beds.

Any reactive column that is known to the skilled person can be used in the process of the invention. In one implementation of the process of the invention, a reactive column containing one or more catalyst beds that it integrated with the structure of the distillation column is used. In particular, it is possible to use catalytic columns described in the following patents: U.S. Pat. No. 5,368,691, U.S. Pat. No. 5,523,062, FR-A-2 737 131, FR-A-2 737 132, EP-A-0 461 855.

U.S. Pat. Nos. 5,431,888, 5,013,407 and 5,026,459 describe reactive columns than can be used in an etherification process, however it is also possible to use said columns to carry out the selective hydrogenation step of the process of the invention (step b)).

When carrying out step b) of the process of the invention, it is also possible to use at least one reactor coupled with a distillation column (side reactor). In this case, the catalytic zone can be partially internal and partially external to the column, or completely external to said column.

Thus it is possible to use a distillation column with no reaction zone, i.e., containing no catalyst, but from which a portion of the liquid in the column is removed from one distillation plate and sent to a selective hydrogenation reactor comprising a fixed bed of catalyst. Preferably, the effluent from said reactor is then returned to the distillation column to the same plate or a neighbouring plate, to ensure continuity of distillation. It is also possible to couple said external reactor with a reactive column comprising at least one bed of catalyst.

Apparatus comprising at least one external reactor that can be used in the process of the invention are described in particular in U.S. Pat. Nos. 5,177,283, 5,817,227 and 5,888,355.

The effluent obtained at the end of the process of the invention, i.e., after step b) or step c), essentially contains saturated hydrocarbons and mono-olefins. Any process layout that is known to the skilled person can be used to separate the olefins contained in this effluent. Fractionation process layouts that can be used with the process of the invention are, for example, described in "Ullman's Encyclopedia of Industrial Chemistry", fifth edition, volume A10, pages 77 and 80.

Said effluent can then, for example, be fractionated to recover the mono-olefins contained in each $C_n$ cut, using a de-methaniser followed by a de-ethaniser for the $C_2^+$ cut which can separate a $C_2$ cut, then a de-propaniser for the $C_3$+ cut, and possibly a de-butaniser for the $C_4^+$ cut and/or a de-pentaniser for the $C_5$+ cut. It is also possible to place the de-ethaniser upstream of the de-methaniser or the de-propaniser upstream of the de-ethaniser. The olefins and paraffins contained in the $C_n$ cuts (n=2 to 5) are then optionally separated, to recover the olefins contained in each of said cuts.

The process of the invention is thus a process for selective hydrogenation of a hydrocarbon feed containing hydrogen and $C_2^+$ hydrocarbons, characterized in that it comprises at least one step for separating a fraction of the hydrogen contained in the feed by means of a membrane (step a)) and a step for selective hydrogenation of the effluent from step a) in a reactive column (step b)).

In a preferred implementation, the process of the invention further comprises a step c) for hydrogenating the effluent from step b). A highly preferred variation of the process of the invention is shown in FIG. 1.

In this variation, feed 1, which essentially comprises hydrogen, hydrocarbons containing 1 to 6 carbon atoms, and possibly $C_6$+ hydrocarbons, is admitted into unit 3 for separating hydrogen using a membrane (step a)). Preferably, a feed from a steam cracking unit is used, for example and preferably a feed removed after the sodium hydroxide washing, compression and drying steps. Such a feed is available at a temperature close to 40° C. and at a pressure of the order of 3 to 3.5 MPa.

In order to improve the separation efficiency of the membrane, it is also preferable to re-heat the feed using re-heater 2, which is preferably an exchanger functioning with the steam used in the steam cracking unit. In the case of an organic membrane, for example, it is preferable to re-heat the feed to a temperature of more than 40° C., more preferably in the range from about 40° C. to about 100° C., for example to a temperature in the range about 70° C. to about 85° C.

At the end of separation, a permeate (effluent 4) is recovered that is enriched in hydrogen, and a retentate (effluent 5) is recovered that is depleted in hydrogen, which contains most of the $C_1$ to $C_6$ hydrocarbons and is sent to reactive column 8 via line 5.

These effluents are obtained at a pressure generally in the range 0.1 to 1.0 MPa.

It is optionally possible to insert in line 5 a compressor 6, to produce a compressed effluent via line 7 and to carry out hydrogenation step b) at a higher pressure, for example in the range 1.0 to 3.5 MPa. It is also possible to re-heat said feed before step b), for example using an exchanger (not shown).

Reactive column 8 comprises either at least one fixed bed of selective hydrogenation catalyst, preferably a plurality of catalyst beds distributed through the column, or at least one external reactor associated with the distillation plates of a simple distillation column or a reactive column, in the implementation described above (side reactors).

Any hydrogenation catalyst that is known to the skilled person can be used in this step b), however a catalyst based on at least one noble metal is preferably used, preferably a palladium-based catalyst such as a catalyst comprising palladium or palladium and silver deposited on alumina or silica or titanium oxide.

FIG. 1 shows an embodiment wherein three catalytic beds 29, 30, 31 are disposed in the reactive column. However, a larger or smaller number of catalytic beds can be used depending on the composition of stream 7 to be hydrogenated.

Reactive column 8 used in step b) of the process of the invention can thus enable simultaneous fractionation of stream 7 comprising hydrocarbons containing 1 to 6 carbon atoms per molecule and hydrogenation of unsaturated hydrocarbons contained in this stream 7, using the hydrogen present in the stream. Preferably, the mole ratio R in streams 5 and 7 is in the range 0.5:1 to 4:1, to allow selective hydrogenation of the $C_2$, $C_3$, $C_4$, $C_5$ or $C_6$ or even $C_6^+$ di-olefins, poly-olefins and acetylenic compounds possibly contained in stream 7, without hydrogenating the mono-olefins.

An at least partially hydrogenated heavy effluent 9 is recovered from the column bottom. This effluent can be recycled in part to the bottom of the catalytic column via line 10, then after re-heating using a reboiler 11 via line 12. The non recycled fraction is recovered via line 13.

A light effluent 14 is recovered overhead and is preferably condensed in condenser 15, then introduced via line 16 into a separator 17. The liquid fraction 18 (reflux) is recycled to reactive column 8 and the gas fraction is recovered via line 19.

In the case when feed 1 is essentially constituted by a $C_1$–$C_6$ cut from a steam cracker, the reactive column preferably functions so as to carry out fractionation of the $C_4$ or $C_5$ hydrocarbons. The light effluent 14 then contains essentially $C_4^-$ or $C_5^-$ hydrocarbons, i.e., hydrocarbons containing respectively at most 4 or 5 carbon atoms per molecule. The heavy effluent 9 contains $C_5^+$ or $C_6^+$ hydrocarbons, i.e., hydrocarbons containing more than 5 or more than 6 carbon atoms per molecule. However, a $C_4$ and/or $C_5$ and/or $C_6$ hydrocarbon fraction can be simultaneously present in both effluents 9 and 14.

Taking the different reactivities of $C_2$ to $C_6$ hydrocarbons into account, and that of the mono-olefins, di-olefins or poly-olefins and acetylenic compounds in the selective hydrogenation reaction, suitable fractionation of stream 7 is carried out in the reactive column, and suitable positioning of catalytic beds in said column. The catalytic columns described in the patents cited above can satisfy these conditions. These columns generally comprise, as in column 8 in FIG. 1, a reflux zone and a reboiling zone wherein the flow rate or temperature can be controlled, to control fractionation in said column. Preferably, column 8 is operated with a reflux ratio in the range 0.1 to 30, more preferably in the range 1 to 25, and still more preferably in the range 5 to 20.

It is also possible to add to the column intermediate refluxes at certain distillation plates (not shown in FIG. 1), to better control the temperature in each of the corresponding zones. It is also possible to recycle at least a portion of the gas fraction recovered via line 19, optionally after total or partial condensation at a temperature lower than that of condenser 15, to one or more locations in catalytic column 8.

The hydrogenation reaction is generally essentially operated in the liquid phase at a temperature in the range 15° C. to 300° C., more preferably in the range 20° C. to 250° C. and very preferably in the range 25° C. to 200° C., or even 30° C. to 150° C., at a pressure in the range 0.5 to 5 MPa, preferably in the range 0.7 to 4 MPa, and more preferably in the range 0.8 to 3 MPa.

The column head temperature is preferably in the range 30° C. to 200° C., preferably in the range 35° C. to 150° C., and the column bottom temperature is generally in the range 40° C. to 350° C., more preferably in the range 70° C. to 300° C., and very preferably in the range 100° C. to 200° C.

In an optional variation of the process of FIG. 1, a second selective hydrogenation reactor 26 is added, which can if necessary complete the selective hydrogenation reaction. This reactor can be a conventional reactor operating with a fixed bed of catalyst, for example a trickle bed reactor. Said reactor can also be a reactive column that may be identical to or different from column 8. Said reactive column is then preferably provided with a reflux zone with a condenser and reboiler, as described for reactive column 8.

When most, preferably all, of the hydrogen contained in stream 7 has been consumed in reactive column 8, preferably the reactor or reactive column 26 is supplied with hydrogen via line 25, using a fraction of the hydrogen recovered in step a). A light hydrogen-containing effluent is recovered overhead from reactor 26 which can optionally be recycled to step a) (separator 3) or to step b) (reactive column 8) and a hydrogenated effluent 27, i.e., containing no more di- or poly-olefins, or acetylenic compounds, is recovered from the bottom of said reactor. When feed 1 is a $C_1$–$C_6$ steam cracking cut, a gasoline containing paraffins and mono-olefins is recovered.

The process of the invention is thus a process for selective hydrogenation of a hydrocarbon feed containing hydrogen and $C_2^+$ hydrocarbons, characterized in that it comprises at least one step for separating a fraction of the hydrogen contained in the feed by means of a membrane (step a)) and a step for selective hydrogenation of the effluent from step a) in a reactive column (step b)).

In the process of the invention, all or part of the hydrogen separated in step a) is optionally sent to a selective hydrogenation unit. The process of the invention can also comprise a step c) for hydrogenating the effluent from step b), and all or a portion of the hydrogen separated from step a) can optionally be sent to step c).

In the process of the invention, the effluent from step a) can optionally be compressed before being hydrogenated in step b). Further, at least a portion of the fraction recovered from the head of the reactive column can optionally be recycled to step a), or to step b), or to step c).

In the process of the invention, preferably at least a portion of the fraction recovered from the head of said reactive column is optionally recycled to step a) or to step b), or optionally to step c).

The feed for the process of the invention is preferably from a steam cracking process, a thermal cracking process or from a pyrolysis process. More preferably, said feed comprises hydrogen and hydrocarbons containing 1 to 6 carbon atoms.

The membrane used in step a) of the process of the invention can optionally be an organic membrane, preferably comprising at least one polymer selected from the group formed by: polyimides, polyaramides, polycarbonates, polysulphones, cellulose derivatives and polyvinyl fluorides.

The membrane used in step a) of the process of the invention can also optionally be a mineral membrane, preferably selected from the group formed by: zeolites, membranes based on carbon fibres, membranes based on microporous silica deposited on a porous support, ceramic membranes and membranes comprising a palladium alloy.

In the process of the invention, the operating conditions and the membrane are preferably selected such that the retentate obtained in step a) generally has a hydrogen: (di-olefins+poly-olefins+acetylenics) mole ratio in the range 0.5:1 to 4:1. The catalyst used in step b) of the invention preferably comprises palladium, or palladium and silver.

The following numeric example illustrates the separation carried out in step a) of the process of the invention. Such a separation can in particular be carried out in separator 3 of FIG. 1.

EXAMPLE 1 (In Accordance with the Invention)

In this example, the feed to be separated had a composition typical of a $C_1$–$C_6$ feed containing hydrogen from a steam cracker. This feed was recovered after the sodium hydroxide washing, compression and drying steps at a flow rate of 150 tonnes per hour (t/h). The flow rates and compositions of the streams are shown in Table 1.

An organic membrane comprising a polyimide type high specific surface area polymer was used to separate about 50% of the hydrogen contained in the feed (step a)), before selective hydrogenation (step b)). The separation was carried out at a temperature of 80° C. and an upstream pressure of 3.5 MPa. The pressure downstream of the membrane was 0.1 MPa. The membrane used had a hydrogen/hydrocarbon and hydrogen/carbon monoxide separation selectivity of 250 for selective extraction of 50% of the hydrogen present in the feed.

Table 1 summarises the compositions and flow rates of the permeate and retentate after separation using the membrane. The membrane used could separate the excess hydrogen and produce a mole ratio R=hydrogen: (di-olefins+poly-olefins+acetylenics) in the retentate of 1.01, and high selectivities for hydrogen in the permeate and for hydrocarbons in the retentate (Table 1). The retentate obtained could then be used in selective hydrogenation step b) without the need for supplemental addition or separation of hydrogen.

TABLE 1

Flow rates and compositions of streams resulting from membrane separation of a $C_1$–$C_6$ feed from steam cracking with a flow rate of 150 t/h. (Temperature: 80° C.; upstream pressure: 3.5 MPa; BD = butadiene)

| | Feed (kmol/h) | Feed (mole %) | Permeate (kmol/h) | Permeate (mole %) | Retentate (kmol/h) | Retentate (mole %) |
|---|---|---|---|---|---|---|
| $H_2$ | 676.00 | 12.14 | 271.17 | 97.18 | 404.83 | 7.65 |
| $CH_4$ | 1654.90 | 29.72 | 2.66 | 0.95 | 1652.24 | 31.24 |
| $C_2H_4$ | 1648.77 | 29.61 | 2.65 | 0.95 | 1646.12 | 31.12 |
| $C_2H_6$ | 300.69 | 5.40 | 0.48 | 0.17 | 300.21 | 5.68 |
| $C_3H_6$ | 642.02 | 11.53 | 1.03 | 0.37 | 640.99 | 12.12 |
| $C_4H_6$BD | 127.51 | 2.29 | 0.21 | 0.08 | 127.30 | 2.41 |
| $C_4H_8$ | 119.72 | 2.15 | 0.19 | 0.07 | 119.53 | 2.26 |
| $C_5H_8$ | 68.49 | 1.23 | 0.11 | 0.04 | 68.38 | 1.29 |
| $C_5H_{10}$ | 57.35 | 1.03 | 0.09 | 0.03 | 57.26 | 1.08 |
| $C_6H_6$ | 139.22 | 2.50 | 0.22 | 0.08 | 139.00 | 2.63 |
| CO | 3.90 | 0.07 | 0.01 | <0.01 | 3.89 | 0.07 |
| $C_2H_2$ | 23.94 | 0.43 | 0.04 | 0.01 | 23.90 | 0.45 |
| $C_3H_4$ | 27.84 | 0.50 | 0.04 | 0.02 | 27.80 | 0.53 |
| $C_3H_8$ | 22.27 | 0.40 | 0.04 | 0.01 | 22.23 | 0.42 |
| $C_4H_4$ | 3.90 | 0.07 | 0.01 | <0.01 | 3.89 | 0.07 |
| $C_4H_{10}$ | 15.03 | 0.27 | 0.02 | 0.01 | 15.01 | 0.28 |
| $C_5H_{12}$ | 7.79 | 0.14 | 0.01 | <0.01 | 7.78 | 0.15 |
| $C_6$ di-olefins | 10.58 | 0.19 | 0.02 | 0.01 | 10.56 | 0.20 |
| $C_6$ mono-olefins | 5.57 | 0.10 | 0.01 | <0.01 | 5.56 | 0.11 |
| $C_6$ paraffins | 12.81 | 0.23 | 0.02 | 0.01 | 12.79 | 0.24 |
| Total (kmol/h) | 5568.30 | 100% | 279.03 | 100% | 5289.27 | 100% |

EXAMPLE 2 (In Accordance with the Invention)

In this example, the feed to be separated in step a) of the process was a $C_1$–$C_6$ feed identical to that of Example 1, but the separation conditions were modified. The membrane used was a polyaramide membrane, the separation temperature was 60° C., the pressure upstream of the membrane was 6 MPa, and the pressure downstream of the membrane was 0.2 MPa.

TABLE 2

Flow rates and compositions of streams resulting from membrane separation of a $C_1$–$C_6$ feed from steam cracking with a flow rate of 150 t/h. (Temperature: 80° C.; upstream pressure: 6 MPa; BD = butadiene)

| | Feed (kmol/h) | Feed (mole %) | Permeate (kmol/h) | Permeate (mole %) | Retentate (kmol/h) | Retentate (mole %) |
|---|---|---|---|---|---|---|
| $H_2$ | 676.00 | 12.14 | 235.00 | 97.19 | 441.00 | 8.28 |
| $CH_4$ | 1654.90 | 29.72 | 2.30 | 0.95 | 1652.60 | 31.03 |
| $C_2H_4$ | 1648.77 | 29.61 | 2.29 | 0.95 | 1646.48 | 30.91 |
| $C_2H_6$ | 300.69 | 5.40 | 0.42 | 0.17 | 300.27 | 5.64 |
| $C_3H_6$ | 642.02 | 11.53 | 0.89 | 0.37 | 641.13 | 12.04 |
| $C_4H_6$BD | 127.51 | 2.29 | 0.19 | 0.08 | 127.32 | 2.39 |
| $C_4H_8$ | 119.72 | 2.15 | 0.17 | 0.07 | 119.55 | 2.24 |
| $C_5H_8$ | 68.49 | 1.23 | 0.10 | 0.04 | 68.39 | 1.28 |
| $C_5H_{10}$ | 57.35 | 1.03 | 0.08 | 0.03 | 57.27 | 1.08 |
| $C_6H_6$ | 139.22 | 2.50 | 0.19 | 0.08 | 139.03 | 2.61 |
| CO | 3.90 | 0.07 | 0.01 | <0.01 | 3.89 | 0.07 |
| $C_2H_2$ | 23.94 | 0.43 | 0.03 | 0.01 | 23.91 | 0.45 |
| $C_3H_4$ | 27.84 | 0.50 | 0.04 | 0.02 | 27.80 | 0.52 |
| $C_3H_8$ | 22.27 | 0.40 | 0.03 | 0.01 | 22.24 | 0.42 |
| $C_4H_4$ | 3.90 | 0.07 | 0.01 | <0.01 | 3.89 | 0.07 |
| $C_4H_{10}$ | 15.03 | 0.27 | 0.02 | 0.01 | 15.01 | 0.28 |
| $C_5H_{12}$ | 7.79 | 0.14 | 0.01 | <0.01 | 7.78 | 0.15 |
| $C_6$ di-olefins | 10.58 | 0.19 | 0.01 | 0.01 | 10.57 | 0.20 |
| $C_6$ mono-olefins | 5.57 | 0.10 | 0.01 | <0.01 | 5.56 | 0.10 |
| $C_6$ paraffins | 12.81 | 0.23 | 0.02 | 0.01 | 12.79 | 0.24 |
| Total (kmol/h) | 5568.30 | 100% | 241.81 | 100% | 5326.48 | 100% |

Table 2 summarises the compositions and flow rates of the permeate and retentate after separation using the membrane. The membrane used could separate the excess hydrogen and produce a mole ratio R=hydrogen: (di-olefins+poly-olefins+acetylenics) in the retentate of 1.01, and high selectivities for hydrogen in the permeate and for hydrocarbons in the retentate (Table 2). The retentate obtained could then be used in selective hydrogenation step b) without the need for supplemental addition or separation of hydrogen.

What is claimed is:

1. A process for selective hydrogenation of a hydrocarbon feed containing hydrogen and $C_2$+ hydrocarbons comprising diolefins, polyolefins and acetylenics with the provision that said hydrogen in the feed is present in a stoichiometric excess of that required for saturating the monoolefins, diolefins, polyolefins and acetylenics, said process comprising a) at least one step for separating a fraction of the hydrogen contained in the feed by means of a membrane under conditions to produce a retentate having a mol ratio of hydrogen to the sum of moles of diolefins, polyolefins and acetylenics of 1.8:1 to 1.2:1, and (b) a step for selective hydrogenation of the effluent from step a) in a reactive column.

2. A process according to claim 1, in which all or a portion of the hydrogen separated in step a) is sent to a selective hydrogenation unit.

3. A process according to claim 1, further comprising a step c) for hydrogenation of the effluent from step b).

4. A process according to claim 3, in which all or a portion of the hydrogen separated in step a) is sent to step c).

5. A process according to claim 1, in which the effluent from step a) is compressed before being hydrogenated in step b).

6. A process according to claim 1, in which at least a portion of the fraction recovered overhead from said reactive column is recycled to step a).

7. A process according to claim 1, in which at least a portion of the fraction recovered from the head of said reactive column is recycled to step b).

8. A process according to claim 3, in which at least a portion of the fraction recovered from the head of said reactive column is recycled to step c).

9. A process according to claim 1, in which the feed originates from a steam cracking process, a thermal cracking process or from a pyrolysis process.

10. A process according to claim 1, in which the feed comprises hydrogen and hydrocarbons containing 1 to 6 carbon atoms.

11. A process according to claim 1, in which the membrane used in step a) is an organic membrane.

12. A process according to claim 11, in which the organic membrane comprises at least one polymer selected from the group formed by: polyimides, polyaramides, polycarbonates, polysulphones, cellulose derivatives and polyvinyl fluorides.

13. A process according to claim 1, in which the membrane used in step a) is a mineral membrane.

14. A process according to claim 13, in which the mineral membrane is selected from the group formed by: zeolites, membranes based on carbon fibres, membranes based on microporous silica deposited on a porous support, ceramic membranes and membranes comprising a palladium alloy.

15. A process according to claim 1, in which the catalyst used in step a) comprises palladium, or palladium and silver.

* * * * *

UNITED STATES PATENT AND TRADEMARK OFFICE

CERTIFICATE OF CORRECTION

PATENT NO. : 6,410,811 B2
DATED : June 25, 2002
INVENTOR(S) : Chau et al.

It is certified that error appears in the above-identified patent and that said Letters Patent is hereby corrected as shown below:

Title page,
Item [75], delete "Michel" and insert -- Christophe --.

Item [30], Foreign Application Priority Data, delete "00 0366" and insert -- 00/03066 --.

Signed and Sealed this

Twenty-first Day of January, 2003

JAMES E. ROGAN
*Director of the United States Patent and Trademark Office*